US009749748B2

(12) United States Patent
Cheng et al.

(10) Patent No.: US 9,749,748 B2
(45) Date of Patent: Aug. 29, 2017

(54) ELECTRONIC DEVICE AND METHOD FOR DETECTING PLUG TYPE OF AUDIO DEVICE INSERTED INTO ELECTRONIC DEVICE

(71) Applicant: Chiun Mai Communication Systems, Inc., New Taipei (TW)

(72) Inventors: Chun-Wei Cheng, New Taipei (TW); Chao-Yun Yu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 14/863,893

(22) Filed: Sep. 24, 2015

(65) Prior Publication Data

US 2016/0105747 A1 Apr. 14, 2016

(30) Foreign Application Priority Data

Oct. 10, 2014 (CN) ..... 2014 1 0530822

(51) Int. Cl.
*H04R 29/00* (2006.01)
*H04R 5/04* (2006.01)

(52) U.S. Cl.
CPC ..... *H04R 5/04* (2013.01); *H04R 29/00* (2013.01); *H04R 29/001* (2013.01); *H04R 2420/09* (2013.01)

(58) Field of Classification Search
CPC ..... H04R 29/00; H04R 29/001; H04R 5/04
USPC ..... 381/58–59, 74, 77, 309
See application file for complete search history.

(56) References Cited

U.S. PATENT DOCUMENTS

| | | | | |
|---|---|---|---|---|
| 7,248,707 | B2 * | 7/2007 | Peng | H01R 24/58 381/74 |
| 2012/0314897 | A1 * | 12/2012 | Song | H01R 24/58 381/384 |
| 2013/0058494 | A1 * | 3/2013 | Kim | H03G 3/301 381/74 |
| 2013/0114824 | A1 * | 5/2013 | Wu | H04R 3/12 381/74 |
| 2014/0064512 | A1 * | 3/2014 | Yu | H01R 24/58 381/74 |
| 2015/0110331 | A1 * | 4/2015 | Kwon | H04R 3/02 381/384 |
| 2015/0312666 | A1 * | 10/2015 | Park | H04R 1/1041 381/74 |
| 2016/0035342 | A1 * | 2/2016 | Lee | G10K 11/1788 381/309 |

* cited by examiner

*Primary Examiner* — Disler Paul
(74) *Attorney, Agent, or Firm* — Steven Reiss

(57) ABSTRACT

An electronic device for determining a type of an audio device plugged into the electronic device includes an audio port configured to receive a plug of the audio device, a plug detection system configured to determine a plug type of the audio device from the audio port, and a display configured to display the plug type. The plug type includes a three-section plug and a four-section earphone plug. The three-section plug is either a three-section earphone plug or a three-section external speaker plug.

15 Claims, 4 Drawing Sheets

1: Left audio contact pin

2: Right audio contact pin

3: Ground contact pin

4: Microphone contact pin

ELECTRONIC DEVICE AND METHOD FOR DETECTING PLUG TYPE OF AUDIO DEVICE INSERTED INTO ELECTRONIC DEVICE

FIELD

The subject matter herein generally relates to electronic devices, and more particularly to an electronic device and a method for detecting a plug type of an audio device plugged into the electronic device.

BACKGROUND

Audio devices such as earphones or external speakers have plugs for plugging into electronic devices. The plug for an external speaker includes a left audio contact pin, a right audio contact pin, and a ground contact pin, while the plug for an earphone with a microphone function includes a left audio contact pin, a right audio contact pin, a ground contact pin, and a microphone contact pin. For an electronic device such as a mobile phone, it can always correctly detect, upon insertion, the plug of the earphone with microphone function; however it cannot always correctly detect the plug of the external speaker. The failure of the electronic device to detect the insertion of the plug of the external speaker can cause confusion to the user thereof.

BRIEF DESCRIPTION OF THE DRAWINGS

Implementations of the present technology will now be described, by way of example only, with reference to the attached figures.

DETAILED DESCRIPTION

Figure 1:
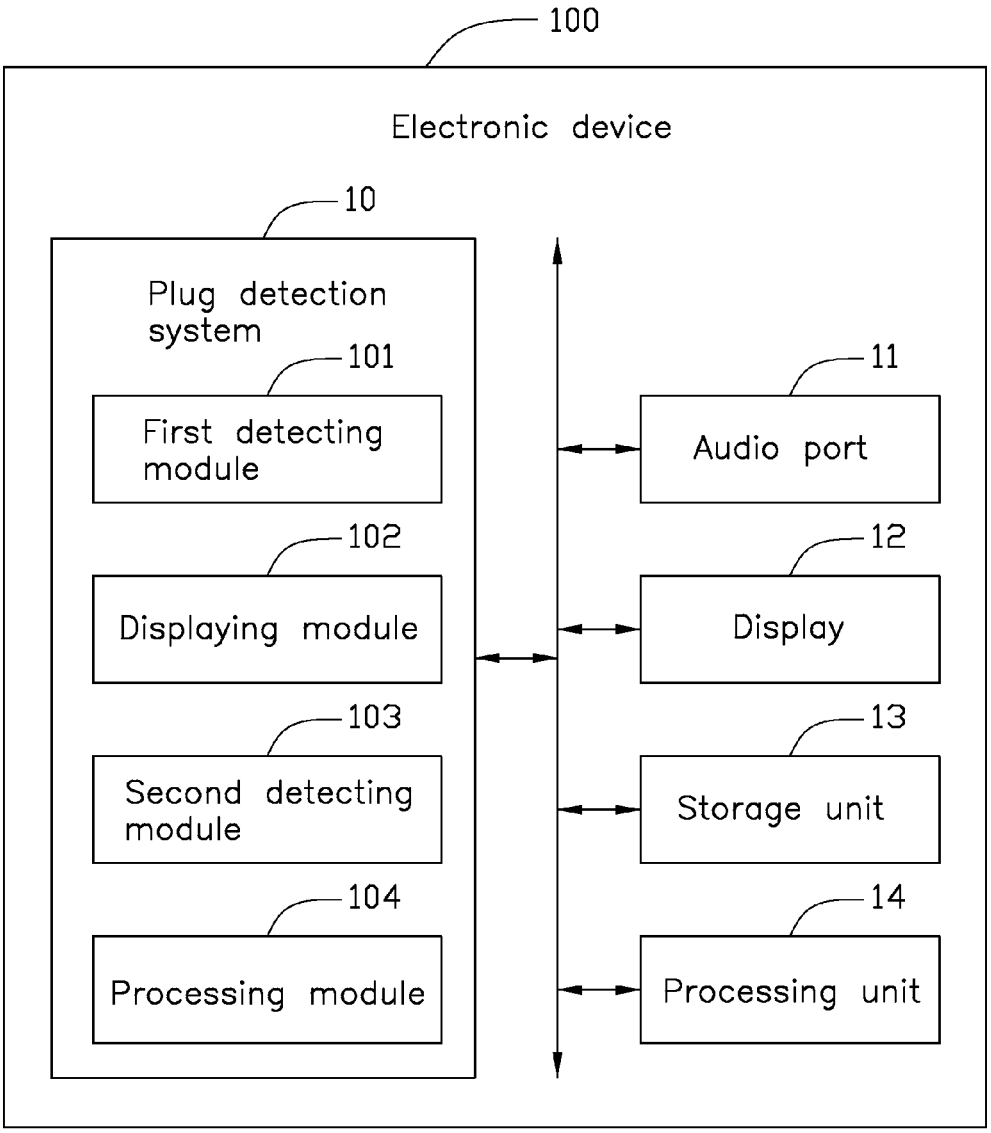
FIG. 1 is a block diagram of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

In general, the word "module" as used hereinafter refers to logic embodied in hardware or firmware, or to a collection of software instructions, written in a programming language such as, for example, Java, C, or assembly. One or more software instructions in the modules may be embedded in firmware such as in an erasable-programmable read-only memory (EPROM). It will be appreciated that the modules may comprise connected logic units, such as gates and flip-flops, and may comprise programmable units, such as programmable gate arrays or processors. The modules described herein may be implemented as either software and/or hardware modules and may be stored in any type of computer-readable medium or other computer storage device.

FIG. 1 illustrates an embodiment of an electronic device 100 for determining a type of an audio device (not shown) plugged therein. The electronic device 100 can include a plug detection system 10, an audio port 11, a display 12, a storage unit 13, and a processing unit 14. The audio port 11 can receive a plug of the audio device. The plug detection system 10 can determine a plug type of the plug plugged into the audio port 11. Thus, the type of the audio device corresponds to the plug type. The display 12 can display the plug type. The plug type can include, but is not limited to, a three-section plug and a four-section earphone plug. The three-section plug can include, but is not limited to, a three-section earphone plug and a three-section external speaker plug. The three-section earphone plug and the four-section earphone plug can be plugs for an earphone or headset. The four-section earphone plug is used for an earphone or headset with microphone function. The three-section earphone plug is used for an earphone or headset without microphone function. The three-section external speaker plug can be a plug for an external speaker or an external sound source.

The plug detection system 10 can include a first detecting module 101, a displaying module 102, a second detecting module 103, and a processing module 104. The modules 101-104 can include one or more software programs in the form of computerized codes stored in the storage unit 13. The computerized codes can include instructions executed by the processing unit 14 to provide functions for the modules 101-104.

Figure 2:
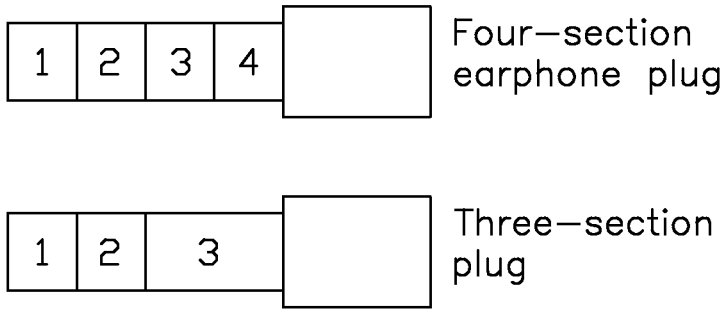
FIG. 2 is a diagrammatic view of a three-section plug and a four-section earphone plug.

Referring to FIG. 2, the four-section earphone plug can include a left audio contact pin 1 (hereinafter "L 1"), a right audio contact pin 2 (hereinafter "R 2"), a ground contact pin 3 (hereinafter "GND 3"), and a microphone contact pin 4 (hereinafter "MIC 4"). The three-section plug can include the L 1, the R 2, and the GND 3.

Figure 3:
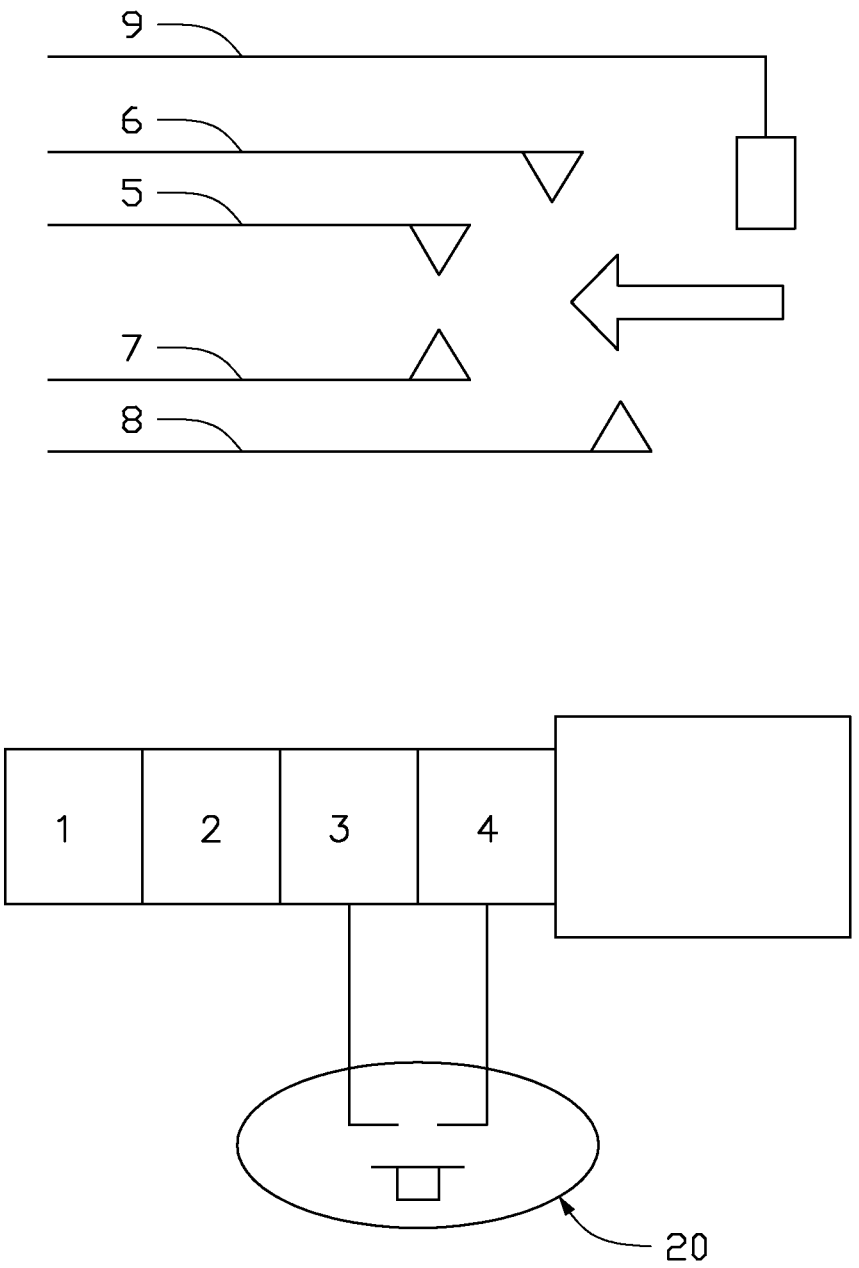
FIG. 3 is a diagrammatic view of a coupling arrangement between an audio port of the electronic device and a plug.

Referring to FIG. 3, the plug can include a hook key 20. The hook key 20 can include two terminals. For the four-section earphone plug, a first terminal of the hook key 20 is electrically coupled to the GND 3, and a second terminal of the hook key 20 is electrically coupled to the MIC 4. For the three-section plug, both the first terminal and the second terminal of the hook key 20 are electrically coupled to the GND 3. The audio port 11 can include a left audio line 5, a right audio line 6, a headset detecting line 7, a ground line 8, and a microphone line 9. When the four-section earphone plug is plugged into the audio port 11, the L 1 is electrically coupled to the left audio line 5 and the headset detecting line 7, the R 2 is electrically coupled to the right audio line 6, the GND 3 is electrically coupled to the ground line 8, and the MIC 4 is electrically coupled to the microphone line 9. The three-section plug is similar to the four-section plug, except that the GND 3 is electrically coupled to both the ground line 8 and the microphone line 9.

The first detecting module 101 can determine whether the plug plugged into the audio port 11 is the three-section plug or the four-section earphone plug. In at least one embodiment, the first detecting module 101 determines that the plug type is the three-section plug when the hook key 20 of the plug is in a pressed state, and the first detecting module 101 determines that the plug type is the four-section earphone plug when the hook key 20 is in an unpressed state. In at least one embodiment, the pressed state of the plug corresponds to a low-level state of a pin of the hook key 20; and the unpressed state of the plug corresponds to a high-level state of the pin of the hook key 20. The pin of the hook key 20 of the four-section earphone plug is in the high-level state because the GND 3 and the MIC 4 are electrically isolated from each other when the GND 3 and the MIC 4 electrically couple to the ground line 8 and the microphone line 9, respectively. The pin of the hook key 20 of the three-section plug is in the low-level state because the microphone line 9 and the ground line 8 are both electrically coupled to the GND 3.

The second detecting module 103 can determine whether the three-section plug is the three-section earphone plug or the three-section external speaker plug. In at least one embodiment, the second detecting module 103 determines that the three-section plug is the three-section earphone plug when the headset detection line 7 of the audio port 11 is at a low level, and the second detecting module 103 determines that the three-section plug is the three-section external speaker plug when the headset detection line 7 is at a high level. In at least one embodiment, the headset detection line 7 is at the high level because the three-section external speaker plug has no internal resistance, so the level of the headset detection line 7 does not change from the high level to the low level when the three-section external speaker plug is plugged into the audio port 11. In contrast, the three-terminal earphone plug has an internal resistance, so the high-level of the headset detection line changes to the low level.

The displaying module 102 can display the plug type on the display 12. Thus, a user can easily know the type of the audio device.

The processing module 104 can enable a microphone of the electronic device 100 when the three-section earphone plug is plugged into the port 11.

Figure 4:
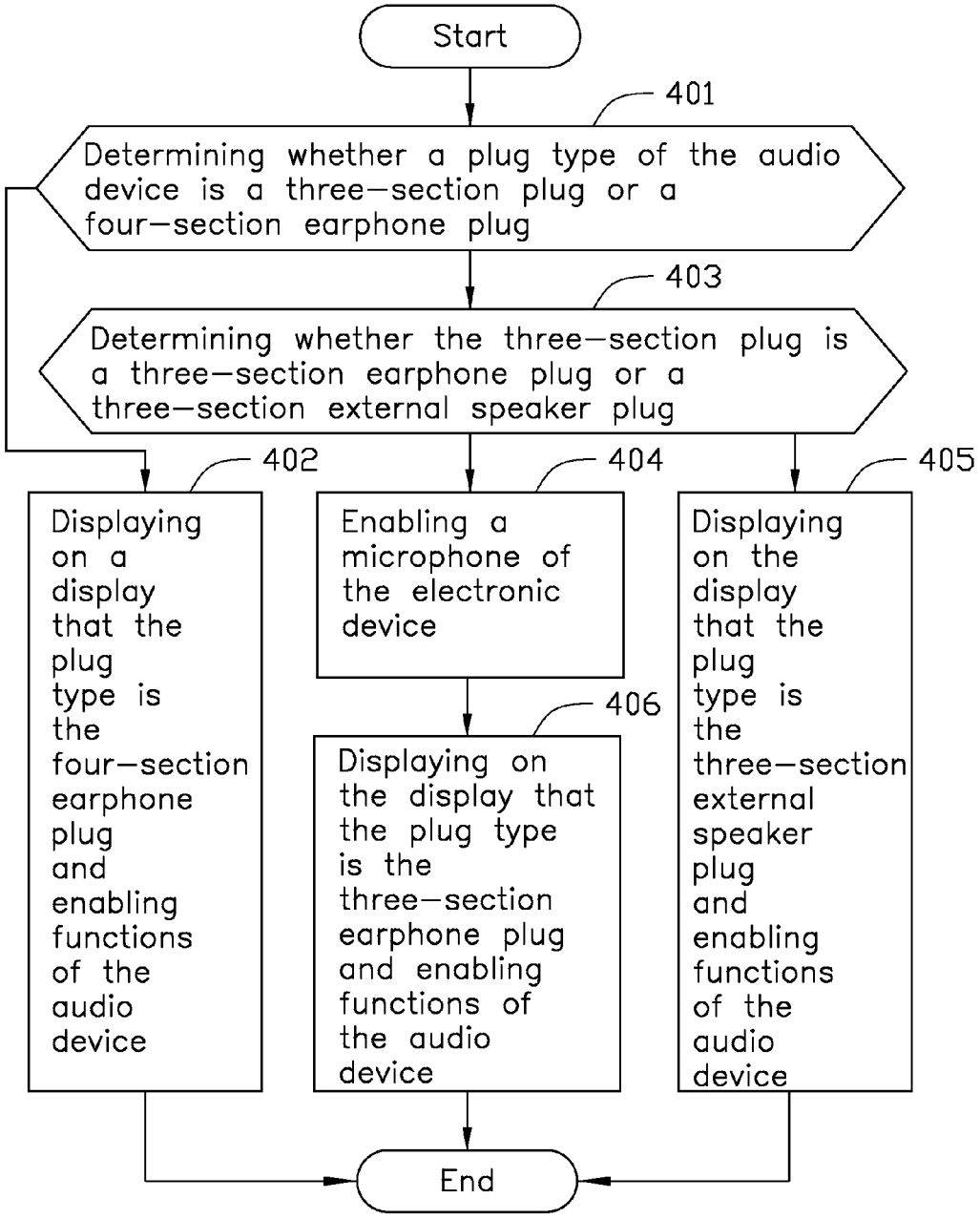
FIG. 4 is a flowchart of an embodiment of a method for determining a type of an audio device.

FIG. 4 illustrates a flowchart of an exemplary method for determining a type of an audio device plugged into an audio port of an electronic device. The example method is provided by way of example, as there are a variety of ways to carry out the method. The method described below may be carried out using the configurations illustrated in FIGS. 1-3, for example, and various elements of these figures are referenced in explaining the example method. Each block shown in FIG. 4 represents one or more processes, methods, or subroutines carried out in the example method. Furthermore, the illustrated order of blocks is by example only, and the order of the blocks may be changed. Additional blocks may be added or fewer blocks may be utilized, without departing from this disclosure. The example method may begin at block 401.

At block 401, the electronic device can determine whether a plug type of the audio device is a three-section plug or a four-section earphone plug. In at least one embodiment, the electronic device determines that the plug type is the three-section plug when a hook key of the plug is in a pressed state, and the electronic device determines that the plug type is the four-section earphone plug when the hook key of the plug is in an unpressed state. The pressed state of the hook key corresponds to a low-level state of a pin of the hook key, and the unpressed state of the hook key corresponds to a high-level state of the pin of the hook key. A first terminal of the hook key is electrically coupled to a ground contact pin of the four-section earphone plug, and a second terminal of the hook key is electrically coupled to a microphone contact pin of the four-section earphone plug. The pin of the hook key is in the high-level state because the microphone contact pin and the ground contact pin of the four-section earphone plug are electrically isolated from each other when the microphone contact pin and the ground contact pin electrically couple to a microphone line and a ground microphone line, respectively, of the audio port. The two terminals of the hook key are both electrically coupled to the ground contact pin of the three-section plug, and the pin of the hook key is in the low-level state because the microphone line and the ground line of the audio port are both electrically coupled to the ground contact pin of the three-section plug. When the plug type is the four-section earphone plug, block 402 is implemented. When the plug type is the three-section plug, block 403 is implemented.

At block 402, the electronic device can display on a display that the plug type is the four-section earphone plug and enable functions of the audio device.

At block 403, the electronic device can determine whether the three-section plug is a three-section earphone plug or a three-section external speaker plug. In at least one embodiment, the electronic device determines that the three-section plug is the three-section earphone plug when a headset detection pin of the audio port is at a low level, and the electronic device determines that the three-section plug is the three-section external speaker plug when the headset detection pin is at a high level. The headset detection pin of the audio port is at the high level because the three-section external speaker plug has no internal resistance, so the level of the headset detection pin does not change from the high level to the low level when the three-section external speaker plug is plugged into the audio port. In contrast, the headset detection pin of the audio port is at the low level because the three-section earphone plug has an internal resistance, so the level of the headset detection pin changes from the high level to the low level when the three-section earphone plug is plugged into the audio port. When the three-section plug is the three-section earphone plug, block 404 is implemented. When the three-section plug is the three-section external speaker plug, block 405 is implemented.

At block 404, the electronic device enables a microphone thereof, and block 406 is implemented.

At block 405, the electronic device displays on the display that the plug type is the three-section external speaker plug and enables functions of the audio device.

At block 406, the electronic device displays on the display that the plug type is the three-section earphone plug and enables functions of the audio device.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A method comprising:

determining a state of a hook key of a plug of an audio device when an audio port of an electronic device receives the plug, wherein a plug type of the audio device is determined to be a three-section plug when the state of the hook key is in a pressed state; and the plug type of the audio device is determined to be a four-section earphone plug when the state of the hook key is in an unpressed state;

determining whether the three-section plug is a three-section earphone plug or a three-section external speaker plug, when the plug type is the three-section plug;

enabling a microphone of the electronic device when the three-section plug is determined to be the three-section earphone plug; and enabling functions of the audio device.

2. The method as in claim 1, further comprising:

displaying the plug type on a display of the electronic device.

3. The method as in claim 1, wherein the pressed state of the hook key corresponds to a low-level state of a pin of the hook key; and the unpressed state of the hook key corresponds to a high-level state of the pin of the hook key.

4. The method as in claim 3, wherein:

the four-section earphone plug has a ground contact pin and a microphone contact pin;

the audio port has a microphone line and a ground microphone line;

a first terminal of the hook key is electrically coupled to the ground contact pin of the four-section earphone plug, and a second terminal of the hook key is electrically coupled to the microphone contact pin of the four-section earphone plug; and the pin of the hook key is in the high-level state because the microphone contact pin and the ground contact pin of the four-section earphone plug are electrically isolated from each other when the microphone contact pin and the ground contact pin electrically couple to the microphone line and the ground microphone line, respectively.

5. The method as in claim 3, wherein:

the three-section plug has a ground contact pin;

the audio port has a microphone line and a ground microphone line;

two terminals of the hook key are both electrically coupled to the ground contact pin of the three-section plug; and the pin of the hook key is in the low-level state because the microphone line and the ground line are both electrically coupled to the ground contact pin of the three-section plug.

6. The method as in claim 1, wherein the three-section plug is determined to be the three-section earphone plug when a headset detection pin of the audio port is at a low level; and the three-section plug is determined to be the three-section external speaker plug when the headset detection pin of the audio port is at a high level.

7. The method as in claim 6, wherein the headset detection pin of the audio port is at the high level because the three-section external speaker plug has no internal resistance, so the level of the headset detection pin does not change from the high level to the low level when the three-section external speaker plug is plugged into the audio port.

8. An electronic device comprising:

an audio port configured to receive a plug of an audio device;

a plug detection system configured to determine a plug type of the audio device from the audio port;

a storage unit configured to store a plurality of instructions of a plurality of modules of the plug detection system; and a processing unit configured to execute the plurality of instructions of the plurality of modules of the plug detection system;

wherein the plug type comprises a three-section plug and a four-section earphone plug; and wherein the three-section plug is either a three-section earphone plug or a three-section external speaker plug;

wherein a first detecting module of the plurality of modules of the plug detection system determines that the plug type is the three-section plug when a hook key of the plug is in a pressed state; and the first detecting module determines that the plug type is the four-section earphone plug when the hook key of the plug is in an unpressed state;

wherein the plurality of modules of the plug detection system further comprises:

a displaying module configured to display the plug type on a display of the electronic device;

a second detecting module configured to determine whether the three-section plug is the three-section earphone plug or the three-section external speaker plug; and a processing module configured to enable a microphone of the electronic device.

9. The electronic device as in claim 8, wherein the microphone is enabled when the plug type is the three-section earphone plug.

10. The electronic device as in claim 8, wherein:

the four-section earphone plug comprises a left audio contact pin, a right audio contact pin, a ground contact pin, and a microphone contact pin;

the three-section plug comprises the left audio contact pin, the right audio contact pin, and the ground contact pin;

the audio port comprises a left audio line, a right audio line, a microphone line, a ground line, and a headset detecting line;

the left audio contact pin of the four-section earphone plug and the three-section plug electrically couples to the left audio line and the headset detecting line;

the right audio contact pin of the four-section earphone plug and the three-section plug electrically couples to the right audio line;

the ground contact pin and the microphone contact pin of the four-section earphone plug electrically couple to the ground line and the microphone line, respectively; and the ground contact pin of the three-section plug electrically couples to both the ground line and the microphone line.

11. The electronic device as in claim 10, wherein the pressed state of the hook key corresponds to a low-level state of a pin of the hook key; and the unpressed state of the hook key corresponds to a high-level state of the pin of the hook key.

12. The electronic device as in claim 11, wherein:

a first terminal of the hook key is electrically coupled to the ground contact pin of the four-section earphone plug, and a second terminal of the hook key is electrically coupled to the microphone contact pin of the four-section earphone plug; and the pin of the hook key is in the high-level state because the microphone contact pin and the ground contact pin of the four-section earphone plug are electrically isolated from each other when the microphone contact pin and the ground contact pin electrically couple to the microphone line and the ground line, respectively.

13. The electronic device as in claim 11, wherein:

two terminals of the hook key are both electrically coupled to the ground contact pin of the three-section plug; and the pin of the hook key is in the low-level state because the microphone line and the ground line are both electrically coupled to the ground contact pin of the three-section plug.

14. The electronic device as in claim 10, wherein the second detecting module determines that the three-section plug is the three-section earphone plug when the headset detection pin of the audio port is at a low level; and the second detecting module determines that the three-section plug is the three-section external speaker plug when the headset detection pin of the audio port is at a high level.

15. The electronic device as in claim 14, wherein the headset detection pin of the audio port is at the high level because the three-section external speaker plug has no internal resistance, so the level of the headset detection pin does not change from the high level to the low level when the three-section external speaker plug is plugged into the audio port.

* * * * *